US007948186B2

(12) United States Patent
Huang

(10) Patent No.: US 7,948,186 B2
(45) Date of Patent: May 24, 2011

(54) BACKLIGHT CONTROL CIRCUIT HAVING FREQUENCY SETTING CIRCUIT AND METHOD FOR CONTROLLING LIGHTING OF A LAMP

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 311 days.

(21) Appl. No.: 12/214,135

(22) Filed: Jun. 16, 2008

(65) Prior Publication Data

US 2008/0309247 A1 Dec. 18, 2008

(30) Foreign Application Priority Data

Jun. 15, 2007 (CN) ..... 2007 1 0075052

(51) Int. Cl.
*H01J 13/32* (2006.01)

(52) U.S. Cl. ..... 315/112; 315/117; 315/226

(58) Field of Classification Search ..... 315/291, 315/299, 300, 301, 307, 308, 309, 310, 311, 315/313, 317, 320, 322, 32, 50, 51, 52, 56, 315/58, 71, 112, 117, 118, 209 R, 224, 226, 315/361, 362

See application file for complete search history.

(56) References Cited

U.S. PATENT DOCUMENTS

| | | | | |
|---|---|---|---|---|
| 5,907,742 | A | 5/1999 | Johnson et al. | |
| 6,654,268 | B2 | 11/2003 | Choi | |
| 2004/0207532 | A1 | 10/2004 | Smithson | |
| 2006/0138972 | A1 * | 6/2006 | Hsieh et al. | 315/291 |
| 2006/0273742 | A1 * | 12/2006 | Kim et al. | 315/308 |

FOREIGN PATENT DOCUMENTS

JP 2000-350448 A 12/2000

OTHER PUBLICATIONS

Ming-Dong Zhou, Min Jia , Digital Potentiometer and Its Applications, (1st Ed), published by Digitized Periodical in Feb. 28, 2006. See col. 1, paragraph 1, and figure 1 on p. 65.

* cited by examiner

*Primary Examiner* — Douglas W Owens
*Assistant Examiner* — Jianzi Chen
(74) *Attorney, Agent, or Firm* — Wei Te Chung

(57) ABSTRACT

An exemplary backlight control circuit includes an inverter, a pulse width modulation (PWM) circuit, and a frequency setting circuit. The inverter is configured to provide an alternating current voltage to a lamp. The PWM circuit is configured to provide a pulse control signal to the inverter. The frequency setting circuit is configured to regulate a frequency of the pulse control signal provided by the PWM circuit according to a temperature of the lamp.

16 Claims, 2 Drawing Sheets

| reference temperature (°C) | working frequency (KHz) | binary instruction |
|---|---|---|
| ..... | ..... | ..... |
| 10 | 60 | 11000011 |
| 20 | 55 | 11000000 |
| 30 | 53 | 10101100 |
| 40 | 51 | 10101010 |
| 50 | 49 | 10101000 |
| 60 | 48 | 10000000 |
| 70 | 47 | 01100000 |
| 80 | 46 | 01000000 |
| ..... | ..... | ..... |

BACKLIGHT CONTROL CIRCUIT HAVING FREQUENCY SETTING CIRCUIT AND METHOD FOR CONTROLLING LIGHTING OF A LAMP

BACKGROUND

1. Cross-Reference to Related Application

This application is related to an application by SHUN-MING HUANG entitled BACKLIGHT CONTROL CIRCUIT HAVING FREQUENCY SETTING CIRCUIT AND METHOD FOR CONTROLLING LIGHTING OF A LAMP, filed on the same day as the present application and assigned to the same assignee as the present application.

2. Field of the Invention

The present invention relates to a backlight control circuit including a frequency setting circuit which is configured to regulate a working frequency of a lamp, and to a method for controlling lighting of a lamp using the backlight control circuit.

3. General Background

Liquid crystal displays are commonly used as display devices for compact electronic apparatuses, not only because they provide good quality images but also because they are very thin. Liquid crystal in a liquid crystal display does not emit any light itself. The liquid crystal requires a light source so as to be able to clearly and sharply display text and images. Therefore, a typical liquid crystal display requires an accompanying backlight module. If a cold cathode fluorescent lamp (CCFL) is used in a backlight module, the backlight module generally includes a backlight control circuit. The backlight control circuit is configured for converting a direct current voltage to an alternating current voltage to drive the CCFL.

Referring to FIG. 3, a typical backlight control circuit 100 includes a pulse width modulation (PWM) circuit 110, a frequency setting circuit 140, an inverter 120, and a lamp 130. The PWM circuit 110 is configured to generate a pulse control signal, and output the pulse control signal to the inverter 120. The inverter 120 is configured to convert an external direct current voltage to an alternating current voltage to drive the lamp 130 under the control of the pulse control signal. The frequency setting circuit 140 is configured to set a frequency of the pulse control signal outputted by the PWM circuit 110.

The PWM circuit 110 includes a working frequency capacitor terminal 111 and a working frequency resistor terminal 112.

The frequency setting circuit 140 includes a capacitor 141 and a resistor 142. The capacitor 141 is connected between the working frequency capacitor terminal 111 of the PWM circuit 110 and ground. The resistor 142 is connected between the working frequency resistor terminal 112 and ground. A capacitance of the capacitor 141 can be 220 picofarads (pF). A resistance of the resistor 142 can be 240 kiloohms (KΩ).

The PWM circuit 110 can be an OZ960 type IC. The frequency of the pulse control signal outputted by the PWM circuit 110 is determined by the capacitor 141 and the resistor 142 of the frequency setting circuit 140. The frequency of the pulse control signal can be calculated according to the following formula (1):

$$f_s = \frac{70 \times 10^4}{C \times R}. \quad (1)$$

In formula (1), "$f_s$" denotes the frequency of the pulse control signal, and a unit of the pulse control signal is kilohertz (KHz). "R" denotes the resistance of the resistor 142, and a unit of the resistance is kiloohms. "C" denotes a capacitance of the capacitor 141, and a unit of the capacitance is picofarads.

When the backlight control circuit works normally, a working frequency of the lamp 130 is a frequency of the alternating current voltage outputted by the inverter 120, and is the same as the frequency of the pulse control signal. In general, because the capacitance of the capacitor 141 and the resistance of the resistor 142 are fixed, the frequency of the alternating current voltage outputted by the inverter 120 and the frequency of the pulse control signal are fixed. Thus, the working frequency of the lamp 130 is fixed.

However, under different working temperatures, the lamp 130 has different equivalent resistances which correspond to different optimal working frequencies. The lamp 130 has a highest luminous efficiency only when the lamp 130 works with an optimal working frequency. When a temperature of the lamp 130 changes from a normal working temperature, the actual working frequency of the lamp 130 remains the same and thereby deviates from the optimal working frequency. Thus the luminous efficiency of the lamp 130 is reduced.

Therefore, a new backlight control circuit that can overcome the above-described problems is desired. What is also desired is a method for controlling lighting of a lamp using such backlight control circuit.

SUMMARY

In one preferred embodiment, a backlight control circuit includes an inverter, a pulse width modulation (PWM) circuit, and a frequency setting circuit. The inverter is configured to provide an alternating current voltage to a lamp. The PWM circuit is configured to provide a pulse control signal to the inverter. The frequency setting circuit is configured to regulate a frequency of the pulse control signal provided by the PWM circuit according to a temperature of the lamp.

Other novel features and advantages will become more apparent from the following detailed description when taken in conjunction with the accompanying drawings.

DETAILED DESCRIPTION OF PREFERRED EMBODIMENTS

Figure 1:
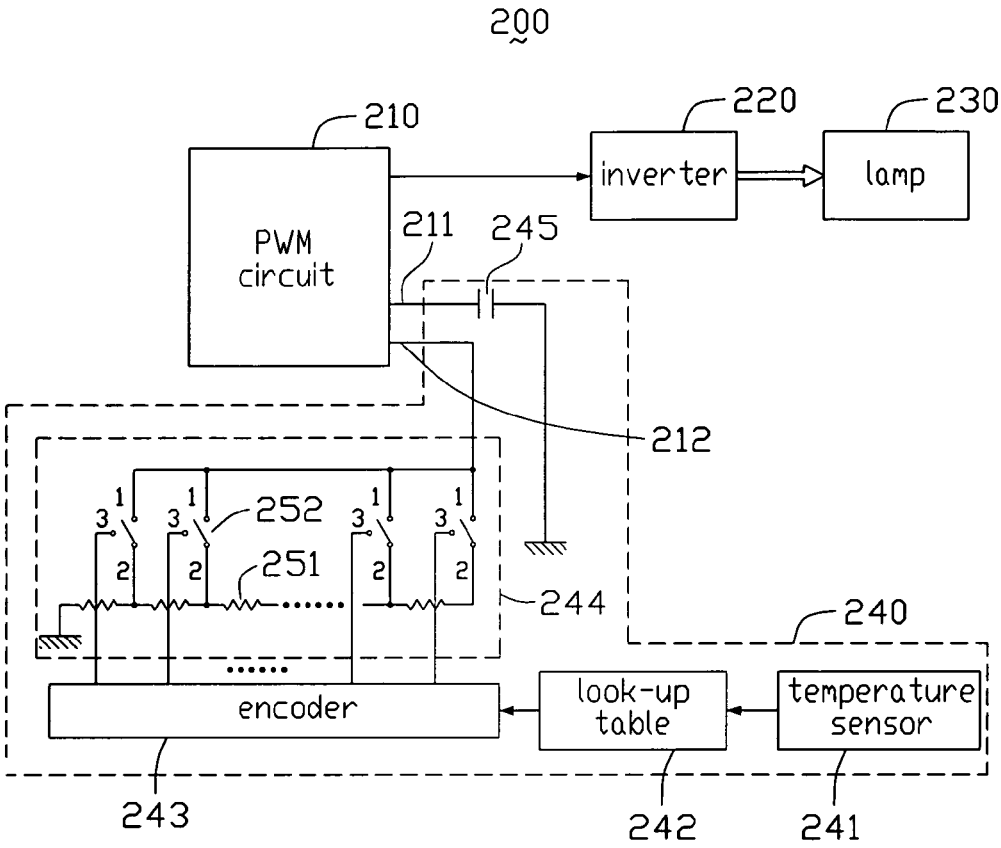
FIG. 1 is essentially an abbreviated diagram of a backlight control circuit according to a first embodiment of the present invention, the backlight control circuit including a look-up table.

Referring to FIG. 1, a backlight control circuit 200 according to an exemplary embodiment of the present invention is shown. The backlight control circuit 200 includes a lamp 230, an inverter 220, a PWM circuit 210, and a frequency setting circuit 240.

The PWM circuit 210 is configured to generate a pulse control signal, and output the pulse control signal to the inverter 220. The inverter 220 is configured to convert an external direct current voltage to an alternating current voltage to drive the lamp 230 under the control of the pulse control signal. The frequency setting circuit 240 is configured to set a frequency of the pulse control signal outputted by the PWM circuit 210 according to a temperature of the lamp 230. Typically, the temperature of the lamp 230 is a temperature when the lamp 230 is working.

The PWM circuit 210 includes a working frequency capacitor terminal 211 and a working frequency resistor terminal 212.

The frequency setting circuit 240 includes a temperature sensor 241, a look-up table 242, an encoder 243, a digitally adjustable resistor 244, and a capacitor 245. The digitally adjustable resistor 244 includes a plurality of resistors 251 connected in series, and a plurality of switches 252. Each switch 252 includes a first terminal 1, a second terminal 2, and a control terminal 3.

The capacitor 245 is connected between the working frequency capacitor terminal 211 of the PWM circuit 210 and ground. The resistors 251 form a series branch which is connected between the second terminal 2 of one of the switches 252 and ground. The first terminals 1 of all the switches 252 are connected to the working frequency resistor terminal 212 of the PWM circuit 210. The control terminals 3 of all the switches 252 are connected to output terminals (not labeled) of the encoder 243 respectively. The second terminals 2 of all the switches 252 (excluding the above-mentioned "one of the switches 252") are connected to nodes between adjacent resistors 251 respectively.

The temperature sensor 241 is disposed adjacent to the lamp 230, and is configured to sense a working temperature of the lamp 230, and output a reference temperature to the look-up table 242 according to the working temperature of the lamp 230. In the present embodiment, a value of the reference temperature is a whole-number multiple of ten, e.g., 0, 10, 20, or 30, and a unit of the reference temperature is degrees Celsius. If the actual working temperature T of the lamp 230 satisfies the following inequality (2):

$$T-[T\div 10]\times 10<[(T+10)\div 10]\times 10-T \quad (2),$$

the reference temperature is equal to [T+10]×10; and if the actual working temperature T of the lamp 230 satisfies the following inequality (3):

$$T-[T\div 10]\times 10\geqq[(T+10)\div 10]\times 10-T \quad (3),$$

the reference temperature is equal to [(T+10)÷10]; wherein [X] denotes a maximum integer which is less than or equal to X.

For illustrative purposes, and actual example is described as follows. If the sensed working temperature of the lamp 230 is 32 degrees Celsius, then 32−[32÷10]×10=2<8=[(32+10)÷10]×10−32, and therefore the temperature is equal to [32÷10]×10=30 degrees Celsius.

Figures 2, 3:
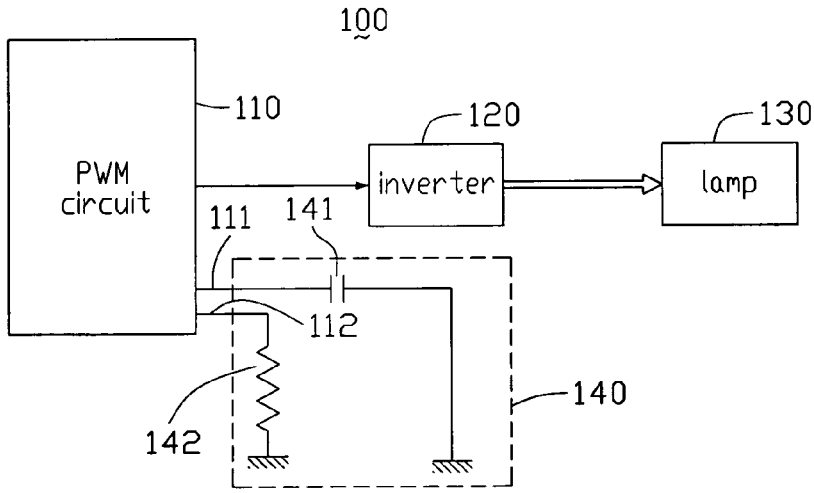
FIG. 3 (RELATED ART)
FIG. 2 is a schematic view of part of the look-up table of FIG. 1.
FIG. 3 is essentially a diagram of a conventional backlight control circuit.

Referring also to FIG. 2, the look-up table 242 is schematically shown. The look-up table 242 includes a plurality of temperature values, a plurality of optimal working frequencies corresponding to the temperature values respectively, and a plurality of binary instructions corresponding to the working frequencies respectively. The look-up table 242 is configured to provide searching of a binary instruction according to the reference temperature outputted by the temperature sensor 241, and provide outputting of the binary instruction to the encoder 243. The encoder 243 is configured to encode the binary instruction, and regulate a resistance of the digitally adjustable resistor 244.

The lamp 230 can be a cold cathode fluorescent lamp (CCFL). The PWM circuit 210 can be an OZ960 type IC. A capacitance of the capacitor 245 can be 220 picofarads. The frequency of the pulse control signal outputted by the PWM circuit 210 can be calculated according to the following formula (4):

$$f_s=\frac{70\times 10^4}{C\times R}. \quad (4)$$

In formula (4), "$f_s$" denotes the frequency of the pulse control signal, and a unit of the pulse control signal is kilohertz (KHz). "R" denotes the resistance of the digitally adjustable resistor 244, and a unit of the resistance is kiloohms. "C" denotes a capacitance of the capacitor 245, and a unit of the capacitance is picofarads.

An exemplary method for controlling lighting of a lamp using the backlight control circuit is as follows. When the backlight control circuit 200 works, the temperature sensor 241 senses a working temperature of the lamp 230, and outputs a reference temperature to the look-up table 242. The look-up table 242 provides searching of a binary instruction according to the reference temperature, and provides outputting of the binary instruction to the encoder 243. In one embodiment, the frequency setting circuit 240 performs such searching and outputting. The encoder 243 encodes the binary instruction, and controls states of the switches 252 of the digitally adjustable resistor 244 in order to regulate a resistance of the digitally adjustable resistor 244. The PWM circuit 210 outputs a pulse control signal to the inverter 220. A frequency of the pulse control signal is determined by the resistance of the digitally adjustable resistor 244 and a capacitance of the capacitor 245. The inverter 220 outputs an alternating current to the lamp 230. A frequency of the alternating current is a working frequency of the lamp 230.

In summary, the backlight control circuit 200 includes the frequency setting circuit 240, which can regulate the frequency of the pulse control signal according to the working temperature of the lamp 230. Even though the working temperature of the lamp 230 changes, the frequency of the lamp 230 does not substantially deviate from an optimal working frequency. Thus the lamp 230 can have good luminous efficiency.

Further or alternative embodiments may include the following. In one example, the look-up table 242 can include individual reference temperatures each of which is an integer, together with corresponding working frequencies and corresponding binary instructions. In such case, the temperature sensor 241 can directly output a working temperature value in the form of an integer, and the reference temperature column in the look-up table 242 can instead be an ambient temperature column. Furthermore, the working frequency of the lamp 230 can be regulated even more precisely.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size and arrangement of parts within the principles of the invention to the full extent indicated by the broad general meaning of the terms in which the appended claims are expressed.

What is claimed is:

1. A backlight control circuit comprising:

an inverter configured to provide an alternating current voltage to a lamp;

a pulse width modulation (PWM) circuit configured to provide a pulse control signal to the inverter; and a frequency setting circuit configured to regulate a frequency of the pulse control signal provided by the PWM circuit according to a temperature of the lamp;

wherein the frequency setting circuit comprises a temperature sensor, a look-up table, an encoder, and an adjustable resistor, the temperature sensor is configured to sense the temperature of the lamp, the look-up table comprises a plurality of temperature values and a plurality of binary instructions corresponding to the temperature values, the encoder is configured to encode the binary instructions, and the frequency setting circuit is further configured to search the look-up table for a binary instruction corresponding to the temperature of the lamp, and output the binary instruction to the encoder to regulate a resistance of the adjustable resistor for regulating the frequency of the pulse control signal provided by the PWM circuit.

2. The backlight control circuit in claim 1, wherein the adjustable resistor comprises a plurality of resistors connected in series and a plurality of switches, each switch comprising a first terminal, a second terminal, and a control terminal, the resistors forming a series branch which is connected between the second terminal of one of the switches and ground, the second terminals of the other switches being connected to nodes between adjacent resistors respectively, and the control terminals of all the switches being connected to output terminals of the encoder respectively.

3. The backlight control circuit in claim 2, wherein the PWM circuit comprises a working frequency capacitor terminal and a working frequency resistor terminal.

4. The backlight control circuit in claim 3, wherein the first terminals of all switches are connected to the working frequency resistor terminal of the PWM circuit.

5. The backlight control circuit in claim 4, wherein the frequency setting circuit further comprises a capacitor connected between the working frequency capacitor terminal of the PWM circuit and ground.

6. The backlight control circuit in claim 5, wherein a capacitance of the capacitor is approximately 220 picofarads.

7. The backlight control circuit in claim 1, wherein the lamp is connected to the inverter.

8. The backlight control circuit in claim 7, wherein the lamp is a cold cathode fluorescent lamp.

9. A method for controlling lighting of a lamp using the backlight control circuit of claim 1, the method comprising:

sensing a temperature of the lamp;

setting a frequency of a pulse control signal provided by the PWM circuit; and the inverter outputting an alternating current voltage to the lamp according to the frequency of the pulse control signal.

10. The method in claim 9, further comprising outputting the sensed temperature to the look-up table.

11. The method in claim 10, wherein setting the frequency of the pulse control signal comprises: the look-up table providing a binary instruction corresponding to the sensed temperature, and outputting the binary instruction to the encoder; the encoder encoding the binary instruction and setting a resistance of the adjustable resistor; and the PWM circuit outputting the pulse control signal to the inverter according to the resistance of the adjustable resistor.

12. The method in claim 11, wherein the adjustable resistor comprises a plurality of resistors connected in series and a plurality of switches, and the encoder switches on or switches off the switches according to the binary instruction thereby adjusting the resistance of the adjustable resistor.

13. A backlight control circuit comprising:

an inverter configured to provide an alternating current voltage to a lamp;

a pulse width modulation (PWM) circuit configured to provide a pulse control signal to the inverter; and a frequency setting circuit configured to regulate a frequency of the pulse control signal provided by the PWM circuit such that the frequency of the pulse control signal varies with changes in a temperature of the lamp;

wherein the frequency setting circuit comprises a temperature sensor, a look-up table, a resistor-adjusting unit, and an adjustable resistor unit, the temperature sensor is configured to sense the temperature of the lamp, the look-up table comprises a plurality of temperature values and a plurality of binary instructions corresponding to the temperature values, the resistor-adjusting unit is configured to search the look-up table for a binary instruction corresponding to the temperature of the lamp and regulate a resistance of the adjustable resistor unit corresponding to the temperature of the lamp, and the PWM circuit is further configured to output the pulse control signal to the inverter according to the resistance of the adjustable resistor unit.

14. The backlight control circuit in claim 13, wherein the resistor-adjusting unit comprises an encoder, the encoder is configured to encode the binary instruction to regulate the resistance of the adjustable resistor unit.

15. The backlight control circuit in claim 14, wherein the PWM circuit comprises a working frequency resistor terminal, and the adjustable resistor unit comprises a plurality of resistors connected in series and a plurality of switches, each switch comprising a first terminal, a second terminal, and a control terminal, the resistors forming a series branch which is connected between the second terminal of one of the switches and ground, the second terminals of the other switches being connected to nodes between adjacent resistors respectively, the first terminals of all the switches being connected to the working frequency resistor terminal of the PWM circuit, and the control terminals of all the switches being connected to output terminals of the encoder respectively.

16. The backlight control circuit in claim 15, wherein the PWM circuit further comprises a working frequency capacitor terminal, and the frequency setting circuit further comprises a capacitor connected between the working frequency capacitor terminal of the PWM circuit and ground.

* * * * *